US012516539B2

(12) United States Patent
Somaschini et al.

(10) Patent No.: US 12,516,539 B2
(45) Date of Patent: Jan. 6, 2026

(54) SAFETY DEVICE FOR A TECHNICAL FLOOR

(71) Applicant: GSA SRL, Cesano Maderno (IT)

(72) Inventors: Valter Nazario Somaschini, Cesano Maderno (IT); Fabio Carlo Somaschini, Cesano Maderno (IT); Giuseppe Somaschini, Cesano Maderno (IT)

(73) Assignee: GSA RL, Cesano Maderno (IT)

( * ) Notice: Subject to any disclaimer, the term of this patent is extended or adjusted under 35 U.S.C. 154(b) by 285 days.

(21) Appl. No.: 18/275,510

(22) PCT Filed: Mar. 9, 2022

(86) PCT No.: PCT/EP2022/055997
§ 371 (c)(1),
(2) Date: Aug. 2, 2023

(87) PCT Pub. No.: WO2022/200043
PCT Pub. Date: Sep. 29, 2022

(65) Prior Publication Data

US 2024/0110401 A1 Apr. 4, 2024

(30) Foreign Application Priority Data

Mar. 26, 2021 (IT) ..... 102021000007487

(51) Int. Cl.
*E04H 9/02* (2006.01)
*E04F 15/024* (2006.01)

(52) U.S. Cl.
CPC ..... *E04H 9/021* (2013.01); *E04F 15/0247* (2013.01)

(58) Field of Classification Search
CPC ..... E04H 9/021; E04F 15/0247; E04F 15/024
See application file for complete search history.

(56) References Cited

U.S. PATENT DOCUMENTS 5,791,096 A 8/1998 Chen
2016/0348831 A1 12/2016 Dombrowski et al.

FOREIGN PATENT DOCUMENTS

CN 111101685 A 5/2020
JP S60-68131 U 5/1985
JP 2008-174900 A 7/2008

OTHER PUBLICATIONS

International Search Report and Written Opinion issued for corresponding PCT International Application No. PCT/EP2022/055997 on Jun. 9, 2022.
Chinese Office Action and Search Report issued for corresponding Chinese Patent Application No. 202280014265X on Jul. 27, 2025.
European Communication Under Rule 71(3) EPC issued for corresponding European Patent Application No. 22711539.1 on Aug. 19, 2025.

*Primary Examiner* — Patrick J Maestri
(74) *Attorney, Agent, or Firm* — Howson & Howson LLP

(57) ABSTRACT

A safety device for supporting bearing columns of a technical floor. The device is configured to be fixed to a slab and comprises a band of a certain length and width comprising a raised central zone, at least two end zones, positioned on a lower level than the raised central zone. The device also comprises a semi-column, fixed to the central zone so as to remain raised as to the end zones. The semi-column comprises an internal diameter greater than the external diameter of each bearing column to which the device is applied. A technical floor comprising bearing columns with the device applied is also disclosed.

12 Claims, 4 Drawing Sheets

SAFETY DEVICE FOR A TECHNICAL FLOOR

TECHNICAL FIELD

The present invention relates, in general, to a safety device to be applied to a technical floor.

In particular, the present invention relates to a safety device with anti-seismic functions to be applied to bearing columns of a technical floor.

BACKGROUND ART

Technical floors are known.

These floors are generally provided in office environments and are made by placing a plurality of bearing columns on a slab of a building and by mounting, on the bearing columns, panels that, once the work has been finished, provide a walking surface of the technical floor.

The walking surface thus created is located at a predefined distance from the slab of the building so as to form an interspace between the walking surface and the slab, whereby it is possible to house in the interspace various technical systems necessary for the correct operation of the environment wherein they are inserted.

It is also known that there are various standards, in particular static type standards, which define bearing classes of technical floors.

For example, these classes, in case of floors, may provide for static operation loads ranging from a minimum of 200 kg to a maximum of 600 kg centered on a predefined surface, for example on a surface of 6.25 $cm^2$, provided for a punch of 25×25 mm.

Technical floors, sized according to static bearing classes, are preferably positioned with the bearing columns simply resting on the slab and, often, comprise anti-noise PADs, made of plastic material, arranged to act as a bearing pad at the base of each bearing column.

In general, if it is provided that technical floors must be sized in order to resist to seismic phenomena and, therefore, in order to support horizontal and vertical accelerations, the prior art provides to intervene on the technical floor in order to make stable the bearing columns.

According to some solutions of the known art it is provided, for example, that the base of the bearing columns be fixed to the slab by way of screws or glue to counteract any vertical accelerations due to seismic or earthquake phenomena. However, this solution shows the problem of eliminating the noise reduction function of the plastic anti-noise PADs.

According to other solutions of the known art, it is provided, for example, to lock, by way of tie-rods/bracings, the upper part of the bearing columns so as to counteract any horizontal accelerations due to the earthquake.

However, this solution shos the problem of partially obstructing the interspace formed between the walking surface of the technical floor and the slab, and therefore of being in contrast with the intrinsic feature of technical floors of forming an interspace, between the walking surface and the slab, in which to house various technical systems.

According to the above solutions of the prior art, it is also provided to modify materials and thicknesses of the bearing columns, so as to counteract seismic phenomena.

For example, the dimensions of the bearing columns are increased in order to increase their thickness and supporting surface and allow them to be hooked more firmly to the slab.

In summary, Applicant has noted that the prior art is not able to effectively solve the problem of providing technical floors which, at the same time, are arranged to counteract seismic phenomena and to not show the limits and problems of the known art, highlighted above.

DISCLOSURE OF THE INVENTION

The object of the present invention is thus to solve the problems outlined above of the known prior art.

The object is achieved by way of the anti-seismic safety device comprising the features set forth in the claims that follow.

The object is also achieved by way of the technical floor comprising the features set forth in the claims that follow.

Claims are an integral part of the technical teaching provided according to present invention.

The following summary of the invention is provided in order to provide a basic understanding of some aspects and features of the invention.

This summary is not an extensive overview of the invention, and as such it is not intended to particularly identify key or critical elements of the invention, or to delineate the scope of the invention. Its sole purpose is to present some concepts of the invention in a simplified form as a prelude to the more detailed description that is presented below.

According to a feature of a preferred embodiment, the anti-seismic safety device is configured in such a way as to provide a bridge structure comprising a bridge-shaped band of a certain length and width and a semi-column with a circular section.

The band, according to a feature of a preferred embodiment, comprises a central zone, raised, and two end zones, operating as a basis of the band, and the semi-column is fixed to the central zone so as to be raised as to the end zones.

The semi-column is preferably fixed to the central zone and the two end zones are configured to be fixed to the slab, for example, by way of suitable bolts passing through holes made in the end zones.

In use, the safety device provides a bridge wherein, as a function the type of installation of the bearing columns, i.e. of the technical floor, the semi-column surrounds with a certain margin greater than zero the tube or the threaded tie-rod and wherein only the end zones of the band are fixed to the slab without interfering with the type of plate resting on the slab.

Preferably, it is provided that the half-column is sized so as to include an internal diameter with dimensions in a range of 1-4 mm greater than the external diameter of the tube or of the threaded tie-rod, depending on whether the base or the head of the bearing column rests on the slab.

For example, depending on the type of installation, the half-column is made with a thickness between 1 and 4 mm and an internal diameter that can be between 15 and 30 mm while respecting the above indication.

The raised central zone of the safety device comprises variable dimensions according to the size of the plate resting, in use, on the slab.

Preferably, the raised central zone is made so as to be raised in a range of 1-6 mm as to the height/thickness of the type of plate resting, in use, on the slab.

Preferably, the end zones of the safety device comprise dimensions suitable for allowing the end zones to be fixed to the slab.

Preferably, the semi-column of the safety device is made so as not to hinder the insertion of the threaded tie-rod into the tube.

Preferably, the height of the half-column as to the slab is about 50-300 mm, according to the technical floors commonly present on the market wherein the base rests on the slab.

In the event that a technical floor is taken as a reference wherein the head of the bearing column rests on the slab, the height of the half-column as to the slab is preferably between about 50-100 mm.

Preferably, the technical floor, comprising bearing columns to which the anti-seismic safety device according to the invention is applied, provides that each of the safety devices is positioned so that the strip of each of the safety devices is oriented at 45° as to a respective side of the panel and at 180° as to the strips of the adjacent safety devices, to better counteract seismic phenomena.

BRIEF DESCRIPTION OF DRAWINGS

These and further features and advantages of the present invention will appear more clearly from the following detailed description of a preferred embodiment, provided by way of non-limiting examples with reference to the attached drawings, in which components designated by same or similar reference numerals indicate components having same or similar functionality and construction and wherein.

BEST MODE FOR CARRYING OUT THE INVENTION

Figure 1:
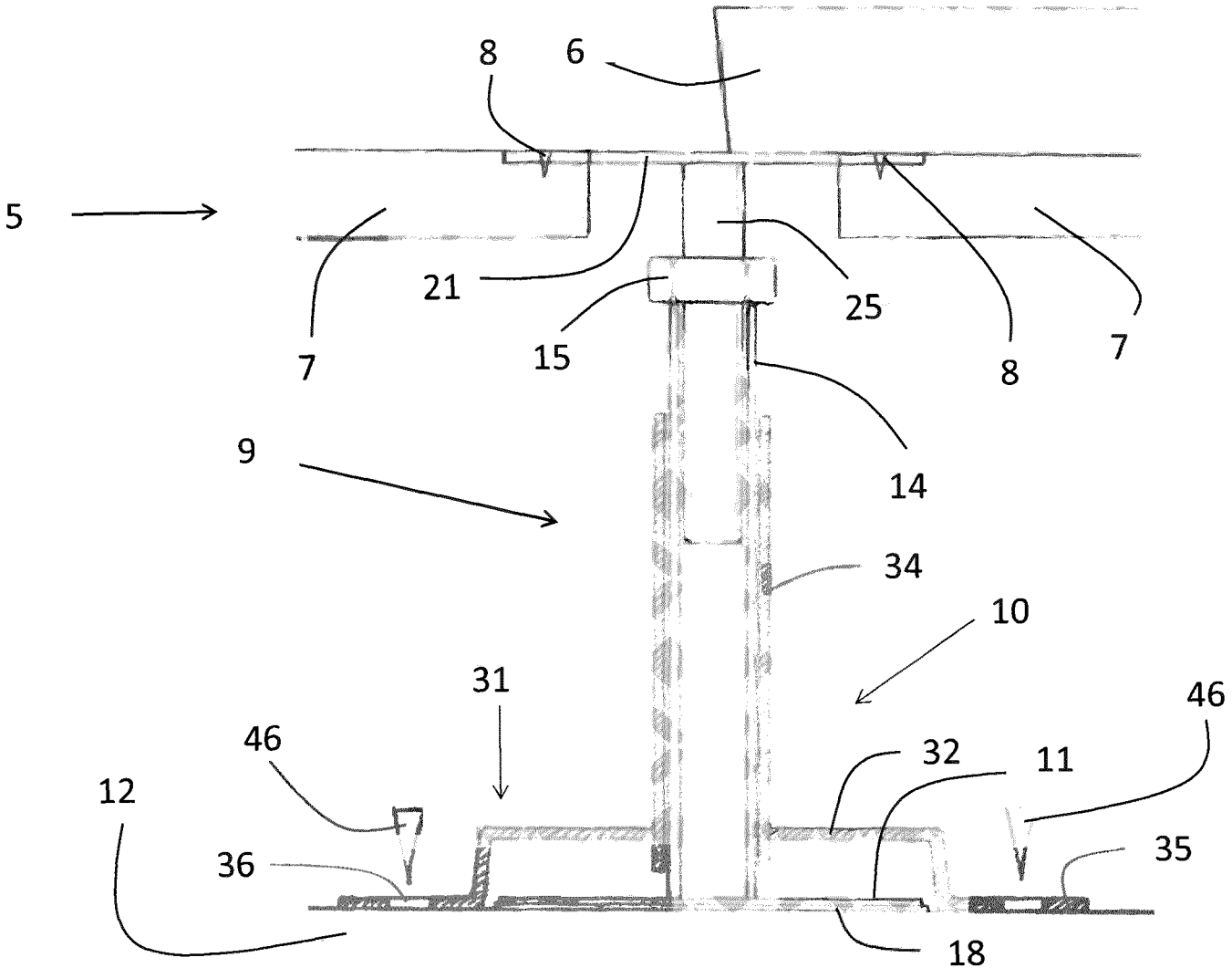
FIG. 1 shows a cutaway side view of a bearing column of a technical floor wherein a safety device according to the invention is applied to it.
Figure 2B:
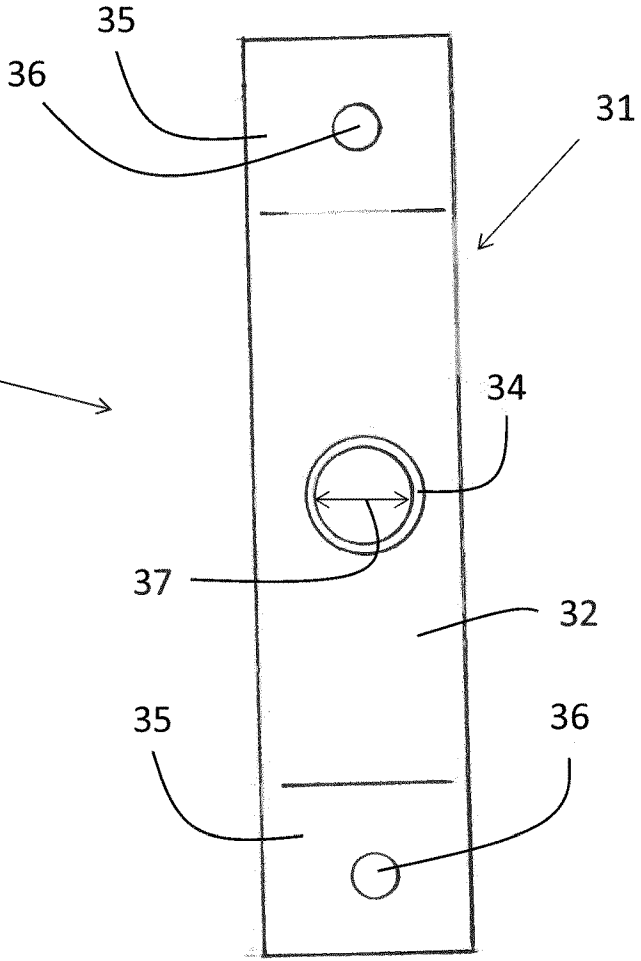
FIGS. 2*a* and 2*b* show, respectively, a cutaway side view and a plan view of the safety device according to the invention.
Figure 2A:
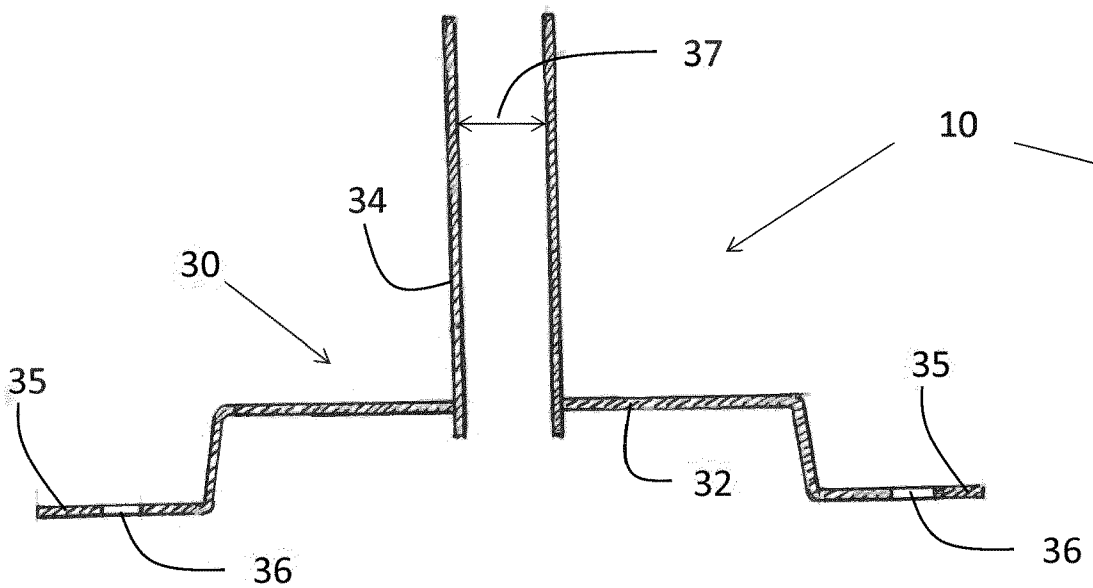

With reference to FIG. 1 it is shown a bearing column 9 of a technical floor 5 to which an anti-seismic safety device 10, made according to the present invention, is applied.

The bearing column 9, disclosed here for completeness, is of a known type and comprises a base plate 11, configured to rest on a slab 12, and a tube 14, with a circular section, which protrudes from the base plate 11 for a predetermined length. The base plate 11 and the tube 14 form the base 19 of the bearing column 9.

The bearing column 9 also comprises a threaded tie-rod 25, which is sized so as to be arranged to slide inside the tube 14, and a threaded nut 15 which is configured to limit, in a known way, the sliding of the threaded tie-rod inside the tube 14 and thus to define the height of the bearing column.

The threaded tie-rod 25 is connected, at one end, to a tie-rod plate 21 configured to support one or more panels 6 of the technical floor 5.

The threaded tie-rod 25 and the tie-rod plate 21 form the head 20 of the bearing column 9.

In use, it is provided that the threaded nut 15 cooperates with the tube 14 of the base 19 to fix the height of the bearing column and, consequently, the height of the panels 6 of the technical floor 5 as to the slab 12.

Preferably, it is also provided that in a technical floor the adjacent bearing columns 9, in particular the respective tie-rod plates 21, are connected by way of crosspieces 7 which are screwed, for example by way of self-tapping screws 8, to adjacent tie-rod plates.

According to a known variant, it is also provided that the bearing columns 9 are installed with an inverted vertical orientation, so that, in use, the heads 20 rest on the slab 12 and the bases 19 support one or more panels 6 of the technical floor 5. The safety device 10 (FIGS. 1, 2*a*, 2*b*, 3*a*, 3*b*) is configured so as to create a bridge structure and comprises a band 31 of a certain length and width, shaped as a bridge, and a semi-column 34 with circular cross section.

The band 31, in the preferred embodiment, comprises a raised central zone 32, two end zones 35, operating as a base of the band and positioned on a lower plane than the central zone.

The semi-column 34 is fixed to the central zone so as to be raised above the end zones.

The central zone 32 and the semi-column 34 are raised as to the height/thickness of the type of plate, 11 or 21, resting, in use, on the slab.

The semi-column 34 is preferably fixed to the central zone 32 in a barycentric position and the two end zones 35 are configured so as to be fixed to the slab 12, for example, by way of suitable bolts 46 passing through respective holes 36 obtained in the end zones 35.

The central zone 32 of the band 31 is longer than the intended diameter of the plates, 11 or 21, respectively of the base 19 or of the head 20 of the bearing column, so as not to interfere, in use, with the plates themselves, depending on the type of installation of the technical floor.

The safety device 10 provides, in use, a bridge in which, depending on the type of installation of the bearing columns 9, the semi-column 34 surrounds the tube 14 or the threaded tie-rod 25, and the end zones 35 of the band 31 are fixed to the slab 12 without interfering with the type of plate, 11 or 21, rested on the slab 12.

According to the preferred embodiment, the band 31 of the safety device 10 has a thickness of between 1-4 mm and comprises variable dimensions according to the dimensions of the bearing column 9 provided for the construction of the technical floor 5.

Preferably, the semi-column is sized so as to comprise an inside diameter 37 with dimensions in a range of 1-4 mm greater than the external diameter of the tube 14 or of the threaded tie-rod 25, depending on the fact that the base 19 or the head 20 of the bearing column 9 rests on the slab.

For example, depending on the type of installation, the semi-column 34 is made with a thickness between 1 and 4 mm and an internal diameter that can be between 15 and 30 mm still respecting the above indication.

According to the preferred embodiment, the raised central zone 32 of the safety device 10 comprises variable dimensions according to the dimensions of the plate, 11 or 21, resting, in use, on the slab 12.

Preferably the central zone 32 is made in such a way as to be larger in size in a range of 1-40 mm as to the diameter of the type of plate resting, in use, on the slab 12.

According to the preferred embodiment, the end zones 35 of the safety device 10 comprise dimensions suitable for allowing the end zones to be fixed to the slab 12.

Preferably, the end zones are made in such a way as to comprise dimensions ranging from 20-50 mm both in length and in width.

According to the preferred embodiment, the semi-column 34 of the safety device 10 is made in such a way as not to hinder the insertion of the threaded tie-rod 25 into the tube 14.

Preferably, the height of the semi-column 34 as to the slab is about 50-300 mm, by referring to technical floors commonly on the market wherein the base 19 of the bearing column 9 rests on the slab 12.

If the head 20 of the bearing column 9 rests on the slab 12, the height of the semi-column 34 as to the slab is preferably about 50-100 mm.

The technical floors are made, for example, with panels 6 of 30 mm thickness and bearing columns 9 with bases 19 of 250 mm height and heads 20 of 120 mm height, arranged in such a way as to position the tie-rod plate 21 of the head 20, for example, at a height such as to provide a walking surface at an height between 270-370 mm as to the slab.

According to the preferred embodiment, the safety device is made of steel, carbon or synthetic resin, and the semi-column 34 is fixed to the band 31, for example, by welding, riveting, crimping or other compatible process.

In summary, the anti-seismic safety device 10 is configured to ensure greater stability to the bearing columns 9 of the raised technical floor 5 subjected to seismic action.

The anti-seismic safety device 10, in fact, is shaped in such a way as to have two or more end zones 35 in contact with the slab 12 preferably comprising two or more holes 36 which facilitate fastening to the same slab.

Furthermore, the anti-seismic safety device comprises a raised central zone 32 in order to have no contact points with the base plate 11 or the tie-rod plate 21, of the bearing column 9, depending on the type of technical floor.

A semi-column 34 is fixed in the central zone of the anti-seismic safety device which has the task of transferring to the tube 14 or to the threaded tie-rod 25, depending on the type of technical floor, the stability exerted by the end zones 35 fixed to the slab and allows the bearing column 9 to withstand both horizontal and vertical seismic stresses.

In particular, the anti-seismic safety device 10 allows to not fix the bearing columns 9 directly to the slab 12 and, by surrounding each column by way of a certain margin greater than zero, allows the bearing column 9 to have a minimum of movement both horizontally and vertically, to better cushion the seismic stresses.

In particular, for example, a provision is made for a movement margin between the bearing column and the safety device, even in the vertical direction, of between 1-6 mm.

The safety device 10 disclosed up to now, as experimentally verified by the Applicant, allows the technical floor to overcome horizontal and/or vertical accelerations due to seismic phenomena.

The building of the technical floor 5, according to the present example of embodiment, provides that initially, the bearing columns 9 (FIGS. 3*a* and 3*b*), for example the bases 19, are positioned in a known way on the slab.

In particular, the bases 19 of the bearing columns 9 are rested on the slab 12 preferably providing an anti-noise PAD 18, to act as a bearing pad for each base plate 11.

Preferably, the bases 19 or the heads 20 of the bearing columns 9, i.e. the base plate 11 or the tie-rod plate 21, are not fixed to the slab.

Moreover, initially, according to the preferred embodiment, it is also provided that, for each bearing column, the safety device 10 is positioned so as to overlap the base 19 or the head 20 of each bearing column 9 and to fix it to the slab 12.

According to possible variants, it is provided that the safety device 10 is applied not to all the bearing columns but to a percentage of at least 50% of the bearing columns used for building the technical floor, without thereby departing from the scope of what has been disclosed and claimed.

Preferably, to better contrast the accelerations due to seismic phenomena, the band 31 of the safety device 10 is positioned oriented at 45° as to the side of the panels 6 and at 180° as to the bands of the adjacent safety devices.

Figure 3A:
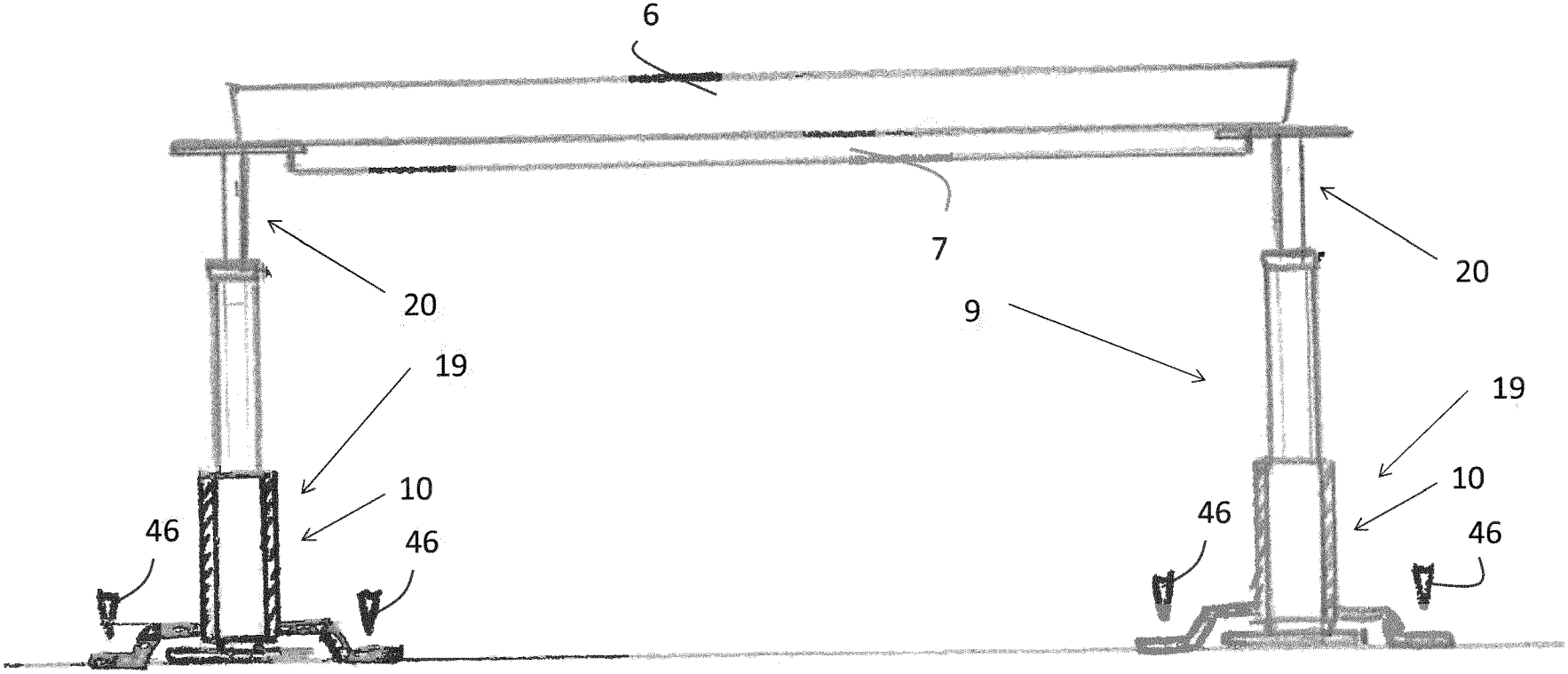
FIGS. 3*a* and 3*b* show, respectively, a side view and a partial plan view of a technical floor made by applying the safety device according to the invention.
Figure 3B:
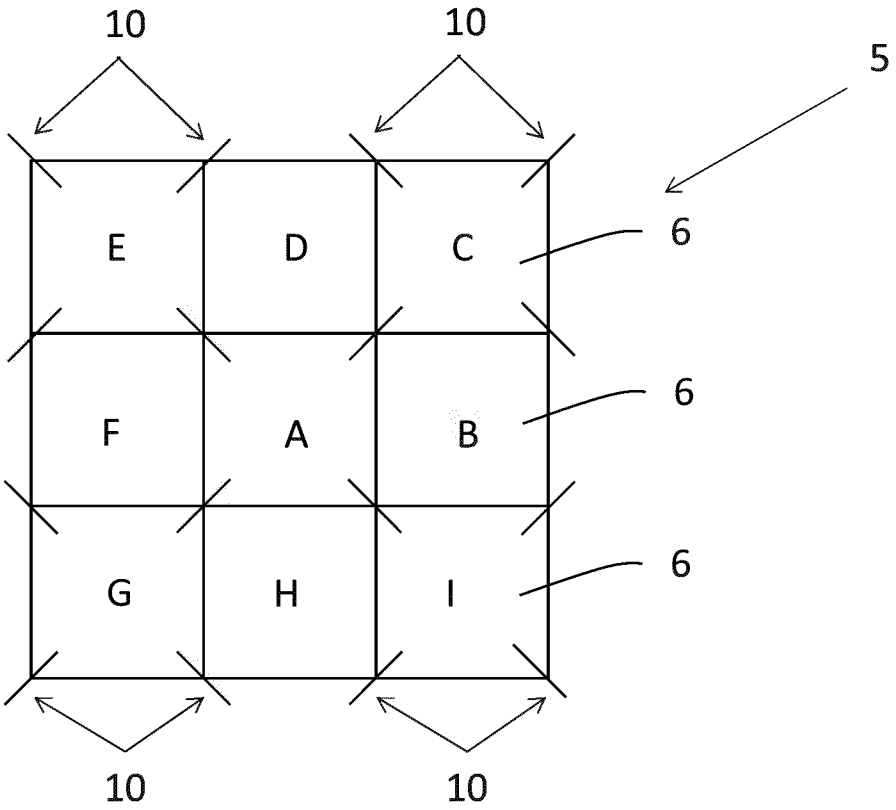

FIG. 3*b* schematically shows the arrangement of the safety devices for a set of 9 panels, for example from "A" to "I", of a technical floor 5 wherein the safety device is applied, for example, to all the bearing columns.

In an immediately following phase, for example, the heads 20 are mounted and brought to the desired height by way of the threaded nut 15 in order to provide the desired height of the panels 6 and therefore of the technical floor as to the slab 12. Preferably, in this phase, the heads 20 of the bearing columns 9 are connected to each other, for example, by way of the crosspieces 7 that, for example, are screwed by way of the self-tapping screws 8 to the tie-rod plate 21 of the heads 20.

Once the above phase has been completed, the panels 6 are positioned so as to complete the building of the technical floor 5.

For the sake of completeness, it should be noted that, if the heads 20 of the bearing columns 9 are rested on the slab 12, the threaded nut 15 is screwed to the threaded tie-rod 25 only after having positioned on and fixed to the slab 12 the safety device 10 so as to overlap the head 20 of the bearing column 9.

The Applicant has conducted a plurality of experimental trials on a test group comprising:

- four standard bearing columns 9, with a height between about 260-360 mm (height that represents about 90% of the bearing columns used in technical floors);
- four safety devices comprising semi-columns having a height from the slab between 100-150 mm;
- four crosspieces 7 screwed to the heads of the bearing columns 9;
- a panel 6 of 600×600 mm mounted in simple support above the heads 20 and the crosspieces 7, and loaded with a load of 630 kg evenly distributed on the surface of the panel.

During the tests, in particular, wheghty lateral thrusts were exerted without a collaps of the system.

In summary, Applicant has experimentally verified that the anti-seismic safety device 10 according to the present examplifying embodiment, in particular in the context of technical floors with a height not exceeding 400 mm as to the slab, allows the technical floor to easily overcome seismic events of various kinds, without requiring the use of special materials and without requiring interventions arranged to prejudice the intrinsic characteristics of technical floors.

In the preferred embodiment, the safety device comprises two end zones or feet arranged to be fixed to a slab.

According to other embodiments, the safety device may comprise three or more feet to be fixed to a slab without thereby departing from the scope of what is disclosed and claimed.

According to this variant, it would be possible to provide greater possibilities for fixing the safety device to a slab.

According to further embodiments, the device can be made with two half-shells configured so that the half-shells can be fixed to each other and form the device according to the invention, without thereby departing from the scope of what is disclosed and claimed.

This configuration of the safety device can be convenient if it is provided to apply the anti-seismic safety device to a technical floor already installed and/or in use.

According to still other embodiments, the safety device can be made in a single preformed or molded piece and could include ribs or reinforcing and/or support elements to improve its stability and lateral resistance in the event of seismic events, without thereby depating from the scope of what is disclosed and claimed.

According to still further embodiments, it is provided that the tube of the bearing column and the semi-column of the safety device can comprise an external cross section with a square, oval, rectangular shape, etc., compatible, however, with the described functions, without thereby departing from the scope of what has been disclosed and claimed.

Advantageously, according to the present embodiment, it is provided that the column does not remain constrained to the slab and that it is free to slide both vertically and horizontally for all the tolerance extent that is allowed by the safety device.

The freedom granted to the bearing column vertically and horizontally allows the technical floor to better withstand the horizontal and vertical accelerations due to seismic events.

Advantageously, the technical floor maintains characteristics such that:

the interspace of the technical floor is not obstructed;

the function of the anti-noise PADs, if present, remains intact.

Of course, obvious changes and/or variations to the above disclosure are possible, as regards dimensions, shapes, materials and components, as well as details of the described construction and operation method without departing from the scope of the invention as defined by the claims that follow.

The invention claimed is:

1. A bearing column for a technical floor and an anti-seismic safety device configured to be applied to the bearing column, wherein said bearing column comprises a base comprising a base plate and a tube protruding from the base plate, and a head comprising a tie-rod plate and a threaded tie-rod connected to the tie-rod plate, a threaded nut configured to limit sliding of the threaded tie-rod inside the tube, said base plate or, alternatively, said tie-rod plate being configured to rest, in use, on a slab as a function of the type of installation of the technical floor, wherein said safety device comprises a band of a certain length and width comprising a raised central zone, at least two end zones, positioned on a lower plane as to the raised central zone, and configured to be fixed, in use, to the slab, and a semi-column, comprised in the raised central zone and protruding from the raised central zone so as to be raised as to the end zones, said semi-column comprising an inside diameter greater than the external diameter, alternatively, of said tube or of said threaded tie-rod of said bearing column, as a function of the type of installation of the technical floor, whereby, in use, the safety device is configured to be fixed by way of said at least two end zones to the slab and to surround, by way of said half semi-column, said bearing column, with a certain margin greater than zero.

2. The bearing column with safety device according to claim 1, wherein said semi-column is comprised in a barycentric position as to the raised central zone.

3. The bearing column with safety device according to claim 1, wherein said inside diameter is greater than the external diameter of said bearing column, to which the device is applicable, in a range of 1-4 mm.

4. The bearing column with safety device according to claim 1, wherein the at least two end zones respectively comprise one or more holes provided for fixing the safety device to the slab.

5. The bearing column with safety device according to claim 1, wherein the raised central zone leaves a certain vertical margin of movement as to the base plate or to the tie-rod plate, alternatively.

6. The bearing column with safety device according to claim 5, wherein said certain vertical margin of movement is comprised between 1-6 mm.

7. A technical floor comprising at least one panel and at least four bearing columns configured to support said at least one panel, each of said at least four bearing columns comprising a base comprising a base plate and a tube protruding from the base plate, and a head comprising a tie-rod plate and a threaded tie-rod connected to the tie-rod plate, a threaded nut configured to limit the sliding of the threaded tie-rod inside the tube, wherein, depending on the type of technical floor, said base plate or, alternatively, said tie-rod plate rests, in use, on a slab, and wherein a safety device is applied to each of said at least four bearing columns, and wherein each of said safety devices comprises a band of a certain length and width comprising a raised central zone, at least two end zones, positioned on a lower plane as to the raised central zone, and configured to be fixed, in use, to the slab, and a semi-column, comprised in the raised central zone and protruding from the raised central zone so as to be raised as to the end zones, said semi-column comprising an inside diameter greater than the external diameter, alternatively, of said tube or of said threaded tie-rod of said bearing column, as a function of the type of installation of the technical floor, whereby, in use, the safety device is configured to be fixed by way of said at least two end zones to the slab and to surround, by way of said semi-column, said bearing column, with a certain margin greater than zero.

8. The technical floor according to claim 7, wherein the central zone of the safety device comprises a length greater than the diameter of the base plate or of the tie-rod plate of each of said at least four bearing columns, depending on the type of technical floor.

9. The technical floor according to claim 8, wherein said length, greater than the diameter of the base plate or of the tie-rod plate, is greater in a range comprised between 1-40 mm.

10. The technical floor according to claim 9, wherein the band of each of the safety devices is oriented at 45° as to one side of the at least one panel and at 180° as to the bands of adjacent safety devices.

11. The technical floor according to claim 8, wherein the band of each of the safety devices is oriented at 45° as to one side of the at least one panel and at 180° as to the bands of adjacent safety devices.

12. The technical floor according to claim 7, wherein the band of each of the safety devices is oriented at 45° as to one side of the at least one panel and at 180° as to the bands of adjacent safety devices.

* * * * *